United States Patent [19]

De Maria et al.

[11] Patent Number: 4,515,859

[45] Date of Patent: May 7, 1985

[54] HYDROPHILIC, WATER-ABSORBING ACRYLONITRILE POLYMER FIBER

[75] Inventors: Francesco De Maria, Gulf Breeze, Fla.; William E. Streetman, Cincinnati, Ohio

[73] Assignee: American Cyanamid Company, Stamford, Conn.

[21] Appl. No.: 418,863

[22] Filed: Sep. 16, 1982

[51] Int. Cl.[3] ..... D02G 3/00; D01F 6/18

[52] U.S. Cl. ..... 428/398; 428/364; 428/397; 264/182

[58] Field of Search ..... 428/376, 397, 398, 375, 428/364; 264/182

[56] References Cited

U.S. PATENT DOCUMENTS

| | | | |
|---|---|---|---|
| 2,788,563 | 4/1957 | Stucklik et al. | 428/398 |
| 3,340,571 | 9/1967 | Bishop et al. | 428/397 |
| 3,600,491 | 8/1971 | Shimoda et al. | 428/397 |
| 4,085,174 | 4/1978 | Ishikawa et al. | 428/398 |
| 4,296,175 | 10/1981 | De Maira et al. | 428/376 |

FOREIGN PATENT DOCUMENTS

| | | | |
|---|---|---|---|
| 2124473 | 12/1971 | Fed. Rep. of Germany | 428/397 |

*Primary Examiner*—George F. Lesmes
*Assistant Examiner*—Beverly K. Johnson
*Attorney, Agent, or Firm*—Frank M. Van Riet

[57] ABSTRACT

A hydrophilic, water-absorbing acrylonitrile polymer fiber is obtained when the fiber is structured from a hydrophilic acrylonitrile polymer so as to contain a water-hiding cavity and to have a filament denier in the range of about 0.75–2.0.

8 Claims, No Drawings

HYDROPHILIC, WATER-ABSORBING ACRYLONITRILE POLYMER FIBER

This invention relates to an acrylonitrile polymer fiber which has a combination of physical and esthetic properties which enable such fiber to be characeterized as a "comfort" fiber. More particularly, this invention relates to a hydrophilic, moisture-absorbing acrylonitrile polymer fiber of low denier having desirable dye intensity, excellent physical properties, high wicking rate, rapid drying propensity and highly pleasing tactile properties. Still more particularly, this invention relates to such a fiber having a unique combination of chemical composition, geometric structure and physical properties that provide a balance of fiber qualities that is unusual in an acrylonitrile polymer fiber and results in a truly "comfort" fiber.

Acrylonitrile polymer fiber is a highly desirable fiber for many uses and is particularly desirable for textile uses wherein its excellent dyeability and desirable physical properties provide attractive fiber for apparel and other end products. Like most other synthetic fibers, conventional, prior art acrylonitrile polymer fibers are hydrophobic and show very low moisture regain, poor moisture absorption and low wicking rates. This results in a fiber which under normal environmental conditions lacks those desired esthetic qualities which provide "comfort" fibers.

Natural fibers, such as cotton, are generally characterized as "comfort" fibers and garments made from these fibers are generally deemed comfortable by their wearers. On the other hand, man-made fibers formed from synthetic polymers are generally lacking in the total set of qualities required for comfort. These qualities include esthetic properties as well as chemical and physical properties. Fiber and fabric handle, water vapor absorption and transport, liquid water absorption and transport (wicking), fiber coloration, and fabric weight and construction are important properties that affect whether or not the garment is recognized as being comfortable or not.

In particular, conventional, prior art acrylic fibers are deficient in both water vapor absorption and transport and liquid water absorption and transport. Other properties can be modified by manipulation of fiber properties. Tactile properties approaching those of natural fibers can be achieved by correct combination of fiber denier, cross-sectional shape, tensile modulus, crimp level, and the like. By proper choice of fiber and yarn denier, degree of twist, tightness of weave or knit, etc., the fabric weight and construction can be made to duplicate tactile esthetics of natural fibers.

Therefore, considerable effort has been made to incorporate water absorption and transport properties into acrylic fibers so that the resulting fibers tend to duplicate the physical and tactile properties obtained in natural fibers such as cotton. Acrylonitrile polymer fibers are naturally hydrophobic and non-swelling in the presence of water. Acrylonitrile polymer fibers exhibit low absorption rates and capacity for water in either liquid or vapor state. Various routes have been pursued to modify the acrylonitrile polymer fiber characteristics to improve the hydrophilicity. Such routes have included, for example, treatments to make the fiber surface hydrophilic so as to increase wicking rates; polymer modification to incorporate hydrophilic groups and increase water absorption capacity; and fiber modification to incorporate microcellular or porous regions that can act as reservoirs for absorption of liquid water.

U.S. Pat. No. 3,718,716, issued Feb. 27, 1973 issued to Job et al. and assigned to Mitsubishi Rayon, teaches preparation of polymers containing large amounts of N-3-oxo-hydrocarbon-substituted acrylamides, such as diacetone acrylamide which when incorporated in acrylonitrile polymer fibers can provide enhanced hygroscopic properties. U.S. Pat. No. 3,035,031, issued May 15, 1962 to Evans and assigned to American Cyanamid Company teaches preparation of polymers of acrylonitrile containing polyoxyethylene esters of acrylic acid to provide improved hydrophilic properties. U.S. Pat. No. 3,733,386 issued May 15, 1973 to Shimoda et al. and assigned to American Cyanamid Company, teaches formulation of an acrylonitrile polymer with large amounts of hydrophilic carboxylic acid groups in which the wet-gel fiber is cross-linked and hydrolyzed to provide the hydrophilic groups. British Pat. No. 1,291,738 published Oct. 4, 1972 (Asahi) teaches preparation of copolymer fibers based on acrylonitrile and dialkylacrylamides to provide good hygroscopic properties. British Pat. No. 715,194 published Sept. 8, 1951 (Imperial Chemical Industries) teaches formation of graft polymer fibers based on polymes obtained by grafting acrylonitrile monomer onto a hydrophilic polymer such as polyvinylalcohol, gelatin, starch, polyacrylic acid, polyvinylpyrrolidone, and the like.

The problem with the above and other such teachings is that the amount of hydrophilic compounds or moieties in the polymer necessary to achieve desirable water absorption levels is so high that the resulting polymer is no longer an acrylic polymer and often no longer even has desirable fiberforming properties.

British Pat. No. 1,345,266, published Jan. 30, 1974 (Mitsubishi Rayon) teaches preparation of microcellular acrylic fiber by special drying processes and subsequent treatment of the fiber with sodium hydroxide to provide a hydrophilic surface on the fiber. Japanese Pat. No. 79-43,618 published Dec. 21, 1979 (Asahi) teaches preparation of a microporous fiber by blending parafin with the acrylonitrile polymer spin dope, wet-spinning the blend, and extracting the paraffin from the resulting fiber to provide the micropores. Japanese Pat. No. 77-114,725 published Sept. 26, 1977 (Asahi) teaches spinning a blend of an acrylonitrile copolymer and chlorinated paraffin and extracting the fiber with benzene to yield a multiporous, low density fiber. Japanese Pat. No. 79-68415 (Asahi) teaches spinning a fiber comprising a core of acrylonitrile polymer and a sheath of acrylonitrile polymer and liquid rubber and extracting the rubber with isopropanol to provide a fiber with a porous sheath and high moisture absorption. British Pat. No. 1,541,152, published Feb. 21, 1979 (Bayer) teaches manufacture of a microporous sheathcore fiber structure wherein the core is porous and the sheath is of higher density than the core by dry spinning wherein a non-solvent for the polymer (e.g., polyhydric alcohols and derivatives thereof), is added to the spinning solution and washed from the fiber in a final washing step. British Pat. No. 1,540,976 published Feb. 21, 1979 (Bayer) teaches an improvement over British Pat. No. 1,541,152 wherein substances that may decompose to form gases are added in addition to the non-solvent. U.S. Pat. No. 4,224,269, issued Sept. 23, 1980 to Reinehr etal and assigned to Bayer, teaches a further improvement over British Pat. No. 1,541,152 wherein the microporous sheath-core fiber may be prepared by treatment of the gel fiber exiting the spinneret with steam in which case the non-solvent is optional. British Pat. No. 1,541,199, published Feb. 21, 1979 (Bayer) teaches a further improvement over British Pat. No. 1,541,152 wherein the fiber forming acrylonitrile polymer contains carboxylic acid groups that are converted to the salt form in the fiber after washing out the non-solvent. Japanese Pat. No. 79-101,920 published Aug. 10, 1979 (Toray) teaches wet spinning, a blend of a thermoplastic polymer with softening point equal to or above 100° C. with an acrylonitrile polymer to yield a microporous fiber with high water retention.

Although the concept of a microporous fiber described above may solve many of the problems in manufacture of a hydrophilic acrylonitrile polymer fiber in that the fibers can have high liquid moisture absorption capacity, high wicking rates (when the surface is made hydrophilic), natural handle, and comfortable feed against the skin, and, in addition they are of low density, can provide very light weight fabrics, and their drying rates are fast compared to natural fibers, leading to energy saving in textile processing and home laundering, certain deficiencies arise, due to their multiporous structure and the difficult and costly spinning processes required for their manufacture.

The fibers produced by the processes described immediately above generally have lower strength than conventional acrylonitrile polymer fiber which leads to processing difficulties such as lower yarn spinning speeds, yarn breakage, and reduced spin limits. Also, increased tendencies towards abrasion, fibrillation, and fraying of individual fibers are observed. Furthermore, it is very difficult to stabilize the microporous structure so that subsequent thermal and hot-wet treatments do not effect the size and number of the pores and microvoids. Additionally, the microvoids act as light scattering centers, causing the fiber to be opaque and dull and therefore much larger add-ons of dye are required to achieve the same color values obtained on transparent acrylonitrile polymer fiber, i.e., color (dye intensities) for such fibers are commonly in the range of (25–35% so that 2.5–3.5 times as much dye is generally required for the microporous fiber compared to a transparent fiber and certain deep shades, particularly blacks, are not achievable. A further deterrent is that any change in the size and number of the pores and microvoids in the dyed fiber due to conventional thermal treatment not only affects water absorption capacity but also causes a corresponding change in the apparent color intensity with the result that varying and uneven shades result in the final garments.

What is needed, therefore, is an acrylonitrile polymer fiber that possesses the desirable attributes of water absorption and transport while still possessing high strength, good dyeability, good thermal properties and abrasion resistance, and the like. The provision for such a fiber would fulfill a long-felt need and constitute a significant advance in the art.

New developments in the field of acrylonitrile polymer fiber have led to processes for melt-spinning fiber using a single phase melt of an acrylonitrile polymer and water. While these developments eliminate the need for polymer solvent in processing the polymer to fiber and overcome problems of environmental pollution, solvent recovery, productivity, and the like, there has not as yet been taught the production of a "comfort fiber" by such a melt-spinning procedure.

In accordance with the present invention, there is provided a hydrophilic, moisture-absorbing, acrylonitrile polymer fiber structured from an acrylonitrile copolymer comprising from about 85 to 89 weight percent of acrylonitrile, from about 1 to 3 weight percent of one or more comonomers which provide hydrophilic moieties and a balance of one or more hydrophobic comonomers, said polymer having a number average molecular weight in the range of about 6,000 to 14,750, the fiber structure having a continuous, water-hiding cavity extending throughout the entire fiber length and constituting between about 10% and 40% of the corresponding fiber free of said cavity, said cavity being either open or closed, and said fiber being characterized by a filament denier of about 0.75 to 2.0, a dye intensity of at least about 45%, a shade change due to hot-wet processing of less than about 15, a moisture absorption of at least about 12%, a straight tenacity of at least about 2.5 grams per denier and a wicking index of at least about 100.

The fiber of the present invention has a combination of fiber-forming polymer composition, structural features, dyeability and physical properties that provide the highly desirable features which provide a "comfort fiber", such combination of features not having previously been provided in an acrylonitrile polymer fiber. It is surprising that the combination of polymer composition, water-hiding cavity, and low denier should provide the desired physical properties associated with "comfort fibers".

The fiber of the present invention is provided by a melt-spinning process in which the fiber-forming acrylonitrile polymer and water, in suitable proportions, are prepared as a single-phase melt at a temperature above the boiling point of water at atmospheric pressure and at a pressure which maintains water in the liquid state. The melt thus prepared is extruded through an appropriate spinneret directly into a steam-pressurized solidification zone maintained under conditions of saturation, temperature and pressure which control the rate of release of water from the nascent extrudate and enable the extrudate to be stretched for molecular orientation while it remains within the solidification zone. The special spinneret employed is one which provides to the fiber a water-hiding cavity which extends continuously along the entire fiber length, occupies from about 10 to 40% of the cross-sectional area of the fiber and may be open or closed; i.e., it results in a hollow fiber or a fiber having an open structure such as a C-shaped. Stretching of the nascent extrudate while it is in the solidification zone provides the low denier as well as the necessary physical properties. After the stretched fiber exits from the solidification zone, it is dried under conditions of wet-bulb and dry-bulb temperatures which prevent the substantial formation of voids and microvoids within the solid polymer structure.

Apparatus and procedures for preparing the appropriate cross-sectional shapes for the fibers of the present invention have been disclosed in the prior art. U.S. Pat. No. 4,278,415 issued July 14, 1981 to American Cyanamid Company, teaches apparatus and process for providing hollow fiber using a spinneret containing removable pins within each orifice that provide an annular shaped spinneret capillary, and U.S. Pat. No. 4,296,175 describes the product made by said U.S. Pat. No. 4,278,415. U.S. Pat. No. 4,261,954 issued Apr. 14, 1981 to American Cyanamid Company describes apparatus for making open or crescent-shaped fibers in which part of the spinneret orifice is blocked by an end of a strand of wire bent across two counterbores. None of these patents, however, anticipate or recognize the essential features of the present invention which consist of:

1. Use of a hydrophilic polymer composition whose resultant fiber surface that is hydrophilic and able to achieve high wicking rates;

2. A continuous water hiding cavity in the fiber structure which achieves high water absorption capacity without the fabric composed thereof feeling wet;

3. Maximum acrylonitrile content in the fiber-forming polymer of 89% so that sufficient comonomer content is provided to enable the achievement of high fiber stretch;

4. A low denier fiber to provide a natural soft handle and comfortable feel to the skin of the wearer.

5. A collapsed structure containing essentially no microvoids so that high dye intensity is achieved; and 6. High fiber strength for high speed yarn spinning and for spinning of fine yarns (high yarn counts).

In preparing the acrylonitrile polymer fiber of the present invention, an acrylonitrile copolymer comprising about 85–89 weight percent acrylonitrile, 1–3 weight percent of one or more comonomers providing hydrophilic groups, and the balance of one or more hydrophobic comonomers is employed to provide the fiber structure. The fiber-forming polymer must have a number average molecular weight in the range of about 6000 to 14,750 in order to achieve the low denier and high physical properties. If the polymer contains less comonomer content than that specified, it is not possible to obtain the low denier fiber desired. If the polymer contains more comonomer content than that specified, the desired levels of physical properties are not obtained in the resulting fiber. If the content of comonomer providing hydrophilic moieties is too low, the fiber obtained is deficient in transparency and moisture-absorbing properties. If the content of comonomer providing hydrophilic moieties is too high, the high stretch ratios necessary to obtain the low denier fiber specified cannot be achieved.

Suitable hydrophobic comonomers include for example; methyl acrylate, ethylacrylate, butyl acrylate, methoxymethyl acrylate, beta-chloroethyl acrylate (and the corresponding esters of methacrylic acid); methacrylonitrile; methyl vinyl ketone; vinyl formate, vinyl acetate, vinyl propionate, vinyl stearate, vinyl benzoate; N-vinyl phthalimide, N-vinyl succinimide; methylene malonic esters, itaconic esters; N-vinyl carbazole; vinyl furan; alkyl vinyl esters; diethylcitraconate, diethylmesaconate; styrene, dibromostyrene; vinyl naphthalene; 2-methyl-1-vinylimidazole, 4-methyl-1-vinylimidazole, 5-methyl-1-vinylimidazole and the like.

Suitable hydrophilic comonomers include, for example: acrylic acid, methacrylic acid, itaconic acid, vinyl sulfonic acid, ethylene dicarboxylic acids and their salts; acrylamide, methacrylamide, dimethylacrylamide, isopropylacrylamide; allyl alcohol; vinylpyrrolidone; vinylpiperidone; 1,2-dihydroxypropyl methacrylate, hydroxyethylmethacrylate, and the like.

Preferred hydrophobic comonomers are the methyl esters of acrylic and methacrylic acids, vinyl acetate, methacrylonitrile and styrene. Preferred hydrophilic comonomers are those which are of nonionic character.

In addition to the provision of hydrophilic moieties by use of the comonomers mentioned above, such moieties may arise in other ways. One method for providing such hydrophilic moieties is to polymerize the monomers in the presence of a redox initiator system which introduces high levels of hydrophilic end groups at the polymer chain ends, such as sulfonic acid groups. Another method is to polymerize the monomers in the presence of a preformed hydrophilic polymer, such as polyvinyl alcohol, polyacrylic acid, polyvinylpyrrolidone, polyethylene glycol, polyacrylamide and polypropylene glycol. Still another method is to hydrolyze a suitable proportion of the acrylonitrile units of a preformed acrylonitrile polymer so as to provide therein carboxylic acid and/or acrylamide groups. Yet another method is to modify a portion of the acrylonitrile units of a preformed acrylonitrile polymer by suitable reaction to form hydrophilic units such as by reaction with ethylenediamine to provide therein imidazoline groups, for example. These and other methods known to those skilled in the art can be used alone or in combination to provide or augment the content of hydrophilic moieties in the acrylonitrile polymer used to produce the fiber of the present invention.

Once the desired polymer composition is selected as specified, it is then necessary to prepare the single phase polymer-water melt for extrusion. In general, for purposes of this invention, the polymer-water composition comprises from about 82–87 weight percent polymer and, correspondingly, from about 13–18 weight percent water. If too little water is used, it is difficult to obtain a melt viscosity suitable for providing the low denier fiber contemplated. If too much water is used, it is difficult to provide a fiber that is substantially free from voids and microvoids in the solid polymer structure of the fiber. Within the range of polymer composition and molecular weight specified the desired water content will be within the range specified although variations within this range will arise due to variations in polymer composition and molecular weight of the charge polymers. The polymer-water composition is preferably in the form of small pellets which can be readily fed to an extruder for processing to melt form. It is generally preferable to form such pellets using a suitable pelletizer which forms pellets that are in the range of about 1–10 mesh. To aid in pellet formation and to modify polymer friction characteristics so as to provide good feeding and conveying properties in typical screw extruders used to provide the melt, it is generally desirable to employ small amounts of lubricants in the polymer-water composition. For this purpose, from about 0.001–1.0 weight percent lubricant, preferably 0.05 to 0.5 weight percent, based on the weight of the polymer, are thoroughly mixed with the polymer water composition prior to pelletizing and drying to the proper water content. Suitable lubricants include, for example, polyoxyethylenesorbitan, monolaurate, polyoxyethylenesorbitan monostearate, glycol mono- and distearates, stearic acid and its alkali and alkaline earth metal salts, polyethylene or polypropylene glycol mono- and distearates, organo silicones modified by reaction with ethylene or propylene oxide, polydimethylsilanes, and the like. In addition to the good feel properties they impart to the polymer-water pellets, the lubricants also provide a more uniform melt which results in achievement of higher stretch levels on the nascent extrudate in an easier and more consistent manner.

In addition, other fiber modifying agents generally used in the industry may readily be blended into the polymer paste prior to pelletizing. These additives include pigments, delustrants, antioxidants, thermal stabilizers, and the like.

The lubricated pellets are processed typically in a screw-extruder under at least autogenous pressure to a temperature in the range of about 165°–175° C. whereupon a homogeneous single-phase melt is provided. The exit end of the extruder is fitted with a spinneret assembly through which the melt is extruded using the pressure generated within the screw-extruder to force the melt through the spinneret orifices which provide the desired cross-sectional shape.

The spinneret assembly will contain an orifice plate containing a plurality of orifices and counterbores therefor to provide equal back pressure. The orifices will be of a type that provides a nascent extrudate having either a continuous hollow extending throughout the entire length of the extrudate or a continuous open trough extending throughout the entire length of the extrudate, the latter embodiment resulting in an extrudate which has a cross-section in the shape of the letter C or U, for example. The hollow or open trough formed in the extrudate constitutes from about 10 to 40% of the cross-sectional area of the corresponding fiber not containing such a hollow or trough. Suitable orifice plates for preparing such cross-sectional shapes are described in the patents described above.

The nascent extrudate that emerges from the spinneret will enter directly into a steam pressurized solidification zone maintained under conditions of saturation, pressure and temperature which control the rate of release of water from the nascent extrudate, prevent formation of a separate water phase within the fiber structure and maintain the extrudate in a stretchable state. Generally, the solidification zone will be pressurized with saturated steam at a pressure which provides a temperature which is from about 10° C. to about 45° C. below the melting point of the polymer-water composition selected. Within this range proper solidification will occur and stretching will be readily accomplished.

While the nascent extrudate remains within the steam pressurized solidification zone, it is subjected to stretching both to reduce the fiber-denier and to orient the polymer molecules. Generally, this stretching is carried out in two stretch stages, with the second stage being conducted at a stretch ratio greater than that of the first stage since such procedure leads to higher values of physical properties. Sufficient stretching is conducted to provide fiber which upon completion of processing has a filament denier of about 0.75–2.0, preferably 0.75–1.5. Usually the total stretch effected will be equal to a stretch ratio of at least 25, and preferably greater, relative to the linear velocity of the melt through the spinneret.

After the nascent filament has been stretched as indicated, it emerges from the solidification zone into the atmosphere. It is then dried to remove residual water contained therein under conditions which involve dry-bulb temperatures in the range of 120°–180° C. and wet-bulb temperatures in the range of 60°–100° C. It is necessary to conduct this drying step prior to any uncontrolled or tensionless shrinkage of the extrudate. The drying step may be conducted on the extrudate under tension or in a free-to-shrink condition.

After the stretched extrudate is dried, it is relaxed in steam under pressure to achieve a total shrinkage of about 25–40%. This relaxation step provides a desirable balance between straight and loop physical properties of the resulting fiber.

The fiber of the present invention, when processed as described, contains a water-hiding cavity running continuously throughout the entire fiber length and accounting for about 10–40% of the cross-sectional area of the corresponding solid fiber. The polymer structure of the fiber is highly transparent. However, because of the presence of the water-hiding cavity within the fiber structure which causes light scattering, the resulting fiber has a lower dye intensity than comparable fiber not containing the water-hiding cavity. The dye intensity is somewhat lower for hollow fiber than for fiber of open structure but, in either case, the dye intensity will be greater than that observed with fiber containing a plurality of voids and microvoids arising from processing and not associated with a water-hiding cavity. The fiber of the invention has a dye intensity of at least about 45%, preferably at least 60%, and a shade change of less than about 15 when subjected to hot-wet processing.

By the term "dye intensity", as that term is employed herein and in the appended claims, is meant the relative dye shade achieved compared to that of a wet-spun, cavity-free fiber of the same polymer dyed in the same manner with the same amount of the same dye.

By the expression "shade change due to hot-wet processing", as that term is employed herein and in the appended claims, is meant the change in reflectance of a dyed fiber which is dried at 300 F. for 20 minutes after dyeing.

In addition to the low denier and dyeing characteristics indicated above, the fiber of the present invention also possesses a water absorption value in the range of about 12 to 30 weight percent based on the dry weight of the fiber. The fiber also has a wicking rate index of at least about 100 gram centimeters and a straight tenacity of at least aboaut 2.5 grams per denier.

The fiber, by virtue of its small denier, water absorption and wicking characteristics, structural configuration and physical properties, has delightful esthetic qualities and is extremely comfortable when worn in contact with the human body in the form of a garment. Such garments have the feel and comfort normally associated only with natural fibers such as cotton and wool. Although the fiber shows high moisture absorption similar to cotton and wool, it also exhibits the fast-drying properties associated with synthetic fibers.

The following examples are set forth for purposes of illustration only and are not to be construed as limitations on the present invention except as set forth in the appended claims. All parts and percentages are by weight unless otherwise specified.

In the examples, various characteristics of the acrylonitrile fiber-forming polymer and the fiber are described. The methods whereby these characteristics were obtained will next be discussed.

TEST METHODS

Number Average Molecular Weight

Number average molecular weight, designated $\overline{M}_n$, is determined by gel permeation chromatography (GPC) using a Waters Permeation Chromatograph ®, cross-linked polystyrene gel column packing and dimethyl formamide—0.1 molar lithium bromide solvent. The chromatograph is calibrated using a set average molecular weight, designated $\overline{M}_w$ have been determined by membrane osmometry and light scattering measurements, respectively. The GPC calibration constants are determined by adjusting them to get the best fit between $\overline{M}_n$ and $\overline{M}_w$ values and values calculated from the chromatographs of polydisperse samples.

Dye Intensity

A sample of fiber is dyed with Basic Blue 1 at 0.5 weight percent, based on the weight of fiber, to complete exhaustion. The dyed sample is then dried in air at room temperature and reflectance measurement versus a control using the Color-Eye® at 620 millimicrons. The control is a sample of commercial wet-spun acrylic fiber of the same denier dyed and handled in the same manner as the experimental fiber. The dye intensity is reported as the percent reflectance of that exhibited by the control. In the case where the experimental fiber exhibits more light scattering, the dyed experimental fiber will register less than 100% reflectance and will appear to the eye to be lighter in color.

Shade Change

A twenty gram sample of carded and scoured fiber is dyed with 0.5 weight percent Basic Blue 1, based on the weight of fiber, at the boil until complete exhaustion occurs. One portion of the dyed fiber is dried in air at room temperature. Another portion is dried in an oven at 300° F. for 20 minutes. Reflectances of both samples are obtained using the Color-Eye® at 620 millimicrons. The change in reflectance of the oven-dried sample relative to the reflectance of the air-dried sample is the shade change due to hot-wet processing.

Moisture Absorption

Staple fiber of the fiber being tested at 38 millimeter lengths is spun into 18/1's cotton count yarn and knitted into a plain knit fabric. A representative sample of the trest fabric is saturated in water and then centrifuged at 2950 RPM in an International Clinical Testing Model CL centrifuge for 60 minutes. The damp sample is weighed, then dried 3 hours at 110° C. to obtain the dry weight. Moisture absorption is calculated at 100 (wet weight-dry weight)/dry weight. Tests are run in quadruplicate.

Dry Rate

Fabric samples are sprayed to contain approximately 50% water, by weight. The samples are then equilibrated for 20 hours in a closed container and exposed to atmosphere of 50% relative humidity at 73° C. Weights are determined at various intervals up to 240 minutes.

Wicking

Weighed strips of fabric knit from the test fiber of dimensions 2.5 centimeter by 18 centimeter are suspended from a frame. The lower 5 centimeter of the long dimension is immersed in distilled water. The distance the water rises on each fabric is measured at one and five minutes. Then the fabric strips are removed from the water, allowed to drip 2 minutes and reweighed to measure the amount of water picked up by the fabric. A wicking index, proportional both to the amount of water wicked and to wicking rate (height after 5 minutes), is calculated from the expression:

$$\text{Wicking Index} = \frac{A \times B}{100}$$

wherein A is the weight of water absorbed by a 25 millimeter by 150 millimeter strip after 5 minutes divided by the weight of the strip and B is the height in centimeters to which the water wicked in 5 minutes.

Fabric Hand

Six fabric hand samples are made as standards with subjective ratings of 0–5, with 0 rating for the fabric having the softest, most pleasing hand and 5 rating for the fabric having the most harsh hand. The samples are made up by blending a fiber having a very soft, comfortable hand with a fiber having a harsh, less pleasing hand in various blend ratios. The standard fibers are then rated by a panel of experts with the following results:

| Sample | Theoretical Rating (Linear Scale) | Panel Rating |
|---|---|---|
| 1 | 5.00 | 4.94 |
| 2 | 4.00 | 4.00 |
| 3 | 3.00 | 2.75 |
| 4 | 2.00 | 2.19 |
| 5 | 1.00 | 1.00 |
| 6 | 0.00 | 0.13 |

These standard hand samples are then used as a scale to rate experimental fibers. Fabric samples are prepared for rating as follows: Single knit fabrics are prepared from 18/1 cotton count yarns spun from the experimental fibers. The fabrics are then scoured and mock dyed in a paddle dyeing machine. The fabrics are then treated using 0.5% aqueous nonionic wetting agent at 140°–150° F. for 20 minutes, rinsed and heated at the boil for 15 minutes in dionized water. The fabrics are then treated in a bath at 30/1 water/fabric ratio with 0.25% Ceranine PNS® for softening, tumble dried and steamed on a frame. The experimental fabrics are then rated versus the standards by the panel.

Cavity Extent

Fiber cavity extent is defined as 100 (ratio of the enclosed open part of the cross-sectional area to the sum of the solid part and the open area enclosed by the solid part). Fiber cross-sectional photomicrographs are made and the solid and open areas are measured by planimeter for several fibers.

EXAMPLE 1

The acrylonitrile polymer used in this example has a composition of 85.1 weight percent acrylonitrile and 11.9 weight percent methyl methacrylate grafted onto 3.0 weight percent of commercially available polyvinyl alcohol and a number average molecular weight of 9,100. One part of polymer is compounded with 0.4 part water, 0.0025 part polyoxyethylene-sorbitan monolaurate and 0.0025 part polyvinyl alcohol (same as above). This mixture is extruded into 5×13 millimeter pellets, which are then dried to contain 15.6% water in a tunnel dryer.

The dry pellets are melted in a single screw extruder at a temperature of 160° C. This melt is extruded through a spinneret having 60 C-shaped holes. The C-shaped slit has an outer diameter of 154 microns, inner diameter of 75 microns, and a blocked-out area of 30%. The cross-sectional area of the hole is equal to that of a round hole of a diameter of 127 microns. The resulting filaments are stretched at a total stretch ratio of 88. The first stage of stretch is at a ratio of 16 in a steam atmosphere of 17 psig. The second and third stages are at ratios of 4.0 and 1.4, respectively, in a steam atmosphere of 13 psig. The stretched fiber is dried at a dry-bulb temperature of 127° C. and a wet-bulb temperature of 65° C., relaxed in steam, finished, crimped, dried, and the fiber of 1.5 denier per filament is cut to a staple length of 38 millimeters. The staple fiber is spun into 18/1 cotton count yarn and knit into a 5.75 ounce per square yard fabric. Fiber and fabric test results are given in Table I, below. Cross-section of the fiber is determined to be C-shaped by microscopic examination and similar to that of the spinneret hole. The fiber dries in half the time required to dry cotton.

EXAMPLE 2

The same composition as employed in Example 1 is processed. The spinneret contains 60 C-shaped holes of outer diameter 130 microns, inner diameter 56 microns and blocked-out area of 27%. The cross-sectional area of the hole is the same as for a round hole with diameter of 109 microns. The filaments are stretched at a total stretch ratio of 90X in three stages (10×3.5×2.6). The fiber is dried at 127° C. dry-bulb and 65° C. wet-bulb, steam relaxed, finished, crimped, dried to provide 1.1 denier per filament C-shaped fiber. The fiber is cut into 38 millimeter staple and spun into 18/1 cotton count yarn. The fiber is knitted as in Example 1. Fiber and fabric properties are similar to those given in Table I for Example 1 except that the fabric hand rating is 2.0.

EXAMPLE 3

The polymer-water melt is the same as in Example 1. The spinneret contained 60 holes of outer diameter 130 microns, inner diameter 56 microns and blocked-out area of 27%, the cross-sectional area being equal to that of a round hole of diameter 109 microns. The fiber is spun as in Example 1 and stretched in three stages at stretch ratios of 4.3 in 17 psig steam pressure and 7.5 and 2.0 in 13 psig steam pressure for a total stretch ratio of 65.2. The 2.0 denier per filament fiber is processed as in Example 1 and knit into a 4.9 ounce per square yard fabric. Fiber and fabric properties are also given in Table I, which follows.

COMPARATIVE EXAMPLE A

The procedure of Example 3 is followed in every material detail except that the spinneret 106 C-shaped holes of outer diameter 203 microns, inner diameter 132 microns, blocked-out area of 46% and cross-sectional area equal to a round hole of 154 micron diameter. Total stretch ratio is 89.5 to provide a fiber of 3.1 denier per filament. Fiber and fabric properties are given in Table I, which follows.

COMPARATIVE EXAMPLE B

The procedure of Comparative Example 4 is repeated in every material detail except that the total stretch ratio is 69.8 to provide a fiber of 4.0 denier per filament. Fiber and fabric properties are given in Table I, which follows.

EXAMPLE 4

A polymer composition as in Example 1 is melted in a single-screw extruder at 168 C. The melt is extruded through a spinneret having 144 holes of 100 micron diameter. A wire of 76 micron diameter had been inserted into each hole filling 57% of the cross-sectional area of the hole, the edge of the cross-section of the wire touching the edge of the cross-section of the hole at one point. The resulting filaments are stretched at a total stretch ratio of 26.6 in three stages of 2.6, 2.0, and 5.1 at a steam pressure of 13 psig. The fiber is dried at 127 C. dry-bulb and 65° C. wet-bulb and relaxed in steam to yeild fiber of 1.4 denier per filament. The fiber is crimped after application of a spin finish, dried and cut into 38 millimeter staple. The fiber is spun into 18/1 cotton count yarn and knitted into a sock of 4.6 ounces per square yard. Photomicrographs of fiber cross-sections show the fiber to have a crescent-shaped cross-section. Fiber and fabric properties are given in Table I, which follows.

EXAMPLE 5

A polymer-water composition as in Example 1 is fed into a single-screw extruder and melted at 170° C. The melt is extruded through a spinneret having 151 holes each of 140 microns diameter. In each hole is fitted a pin of 55 microns diameter such that the pin and hole are concentric and form an annulus 32.5 microns wide. The filaments are stretched at a total stretch ratio of 72 in three stages of 10, 3.6 and 2.0 in saturated steam at 13.0 psig. The resulting fiber is dried at 130 C. dry-bulb and 65° C. wet-bulb, related in steam, finished, crimped, dried and cut into 38 millimeter staple length. The 1.5 denier per filament staple is spun into 18/1 cotton count yarn and knit into fabric. The fiber cross-section is examined microscopically and found to be a hollow fiber, consisting of an annulus of solid material with a uniform open area extending continuously the entire length of the fiber and forming a capillary therein. Fiber and fabric properties are given in Table I, which follows.

COMPARATIVE EXAMPLE C

A round fiber is prepared following the procedure of Example 1 except that the spinneret used has 17,055 round holes of diameter 85 microns. Final denier of the staple fiber is 1.44 per filament. Fiber and fabric properties are given in Table I, which follows.

COMPARATIVE EXAMPLE D

A sample of a first dacron commercially available polyester fiberfill is tested to illustrate the necessity for having a hydrophilic polymer in the fiber of the present invention. Results are given in Table I which follows and indicate poor wicking and moisture absorption.

COMPARATIVE EXAMPLE E

A sampe of a second dacron commercially available polyester fiberfill is tested to illustrate the necessity for having a hydrophilic polymer in the fiber of the present invention. Results are given in Table I which follows and indicate poor wicking and moisture regain.

COMPARATIVE EXAMPLE F

A sample of a commercially available microporous fiber is obtained and tested. Results are given in Table I which follow and indicate poor straight tenacity and poor dye intensity.

COMPARATIVE EXAMPLE G

A sample of cotton fabric, 4.5 ounce per square yard from 18/1 cotton count yarn was also tested. Results are also given in Table I which follows.

TABLE I

| Physical Properties | Properties of Various Fibers — Fiber Described in Example No. 1 | 3 | A | B | 4 | 5 | C | D | E | F | G |
|---|---|---|---|---|---|---|---|---|---|---|---|
| Filament Denier | 1.5 | 2.0 | 3.1 | 4.0 | 1.4 | 1.5 | 1.4 | 5.4 | 5.4 | 1.9 | — |
| Straight Tenacity, g/d | 3.2 | 3.2 | 2.7 | 2.2 | 2.7 | 2.9 | 4.4 | — | — | 2.3 | — |
| Loop Tenacity, g/d | 2.7 | 2.9 | 2.0 | 1.2 | 1.7 | 1.9 | 2.8 | — | — | 1.6 | — |
| Straight Elongation, % | 28 | 35 | 38 | 38 | 25 | 29 | 33 | — | — | 36 | — |
| Loop Elongation, % | 25 | 28 | 26 | 17 | 16 | 20 | 21 | — | — | 21 | — |
| Fabric Hand Rating | 2.8 | 2.8 | 5+ | 5+ | 3.3 | 2.8 | 0 | — | — | 1.8 | 2.0 |
| Wicking Height, 5 min, m.m. | 113 | 99 | 107 | 103 | 107 | 108 | 70 | 10 | 10 | 100 | 84 |
| % Water Wicked, owf | 133 | 139 | 127 | 121 | — | 150 | 87 | — | — | — | 155 |
| Wicking Index | 151 | 138 | 136 | 125 | — | 162 | 62 | — | — | — | 130 |
| Moisture Absorption, % | 15.3 | 13 | 18.8 | 16.9 | 16 | 25 | 8 | 5 | 5 | 32 | 45 |
| Dye Intensity, % | 50 | 45 | 39 | 32 | — | 48 | 89 | — | — | 28 | — |
| Shade Change | 7 | 6 | 13 | 13 | 9 | 10 | 5 | — | — | 17 | — |
| Cavity Extent, % | 13 | 12 | 24 | 24 | 36 | 26 | 0 | 12 | 13 | — | 0 |

What is claimed:

1. A melt-spun, hydrophilic, moisture-absorbing acrylonitrile polymer fiber structured from an acrylonitrile copolymer comprising from about 85 to 89 weight percent of acrylonitrile, from about 1 to 3 weight percent of one or more comonomers which provide hydrophilic moieties and the balance of one or more hydrophobic comonomers, said polymer having a number average molecular weight in the range of about 6000 to 14,750, the fiber structure having a continuous water-hiding cavity extending throughout the entire fiber length and constituting between about 10% and 40% of the corresponding fiber free of said cavity, said cavity being open, and said fiber being characterized by a filament denier of about 0.75 to 2.0, a dye intensity of at least about 45%, a shade change due to hot-wet processing of less than about 15, a moisture absorption of at least about 12%, a straight tenacity of at least about 2.5 grams per denier and a wicking index of at least about 100, said fiber exhibiting a comfortable feel to the wearer when formed into a garment.

2. The fiber of claim 1 wherein said hydrophilic comonomer is of nonionic type.

3. The fiber of claim 1 wherein said copolymer is a graft copolymer.

4. The fiber of claim 3 wherein said copolymer is a graft of acrylonitrile and methyl methacrylate on polyvinyl alcohol.

5. The fiber of claim 1 wherein said open structure results from a C-shaped fiber cross-section.

6. The fiber of claim 1 wherein said dye intensity is at least 60%.

7. The fiber of claim 1 wherein said open structure results from a crescent-shaped, fiber cross-section.

8. The fiber of claim 1 wherein said fiber has a filament denier of 0.75–1.50.

* * * * *